United States Patent [19]

Triggs

[11] Patent Number: 4,733,650

[45] Date of Patent: Mar. 29, 1988

[54] SYSTEM FOR COLLECTION OF FATS AND OILS

[76] Inventor: Kenneth O. Triggs, 29/345 Victoria Place, Drummoyne, New South Wales 2047, Australia

[21] Appl. No.: 852,530

[22] Filed: Apr. 16, 1986

[30] Foreign Application Priority Data

Apr. 16, 1985 [AU] Australia ..... RH00174

[51] Int. Cl.[4] ..... E01C 19/45

[52] U.S. Cl. ..... 126/343.5 A; 141/82; 239/130; 414/406

[58] Field of Search ..... 126/343.5 A, 343.5 R, 126/19.5; 222/146.4; 239/654, 650, 106, 130, 136; 134/105, 107, 151; 414/406, 404; 141/67, 82

[56] References Cited

U.S. PATENT DOCUMENTS

| | | | |
|---|---|---|---|
| 328,714 | 10/1885 | Ralston | 126/343.5 A |
| 2,136,738 | 11/1938 | Giordano | 126/343.5 A |
| 2,300,083 | 10/1942 | Worthington | 126/343.5 A |
| 4,237,857 | 12/1980 | Sharp, Sr. | 126/343.5 A |
| 4,360,046 | 11/1982 | Streit et al. | 141/82 |
| 4,450,828 | 5/1984 | Onken et al. | 126/343.5 A |
| 4,505,669 | 3/1985 | Rogers | 126/343.5 A |

FOREIGN PATENT DOCUMENTS

| | | | |
|---|---|---|---|
| 137835 | 10/1947 | Australia . | |
| 84600B/47 | 11/1979 | European Pat. Off. . | |
| 790252 | 11/1935 | France | 222/146.4 |
| 893882 | 4/1980 | U.S.S.R. . | |

*Primary Examiner*—Randall L. Green

*Attorney, Agent, or Firm*—Limbach, Limbach & Sutton

[57] ABSTRACT

A system for the collection of fats and oils is described in which an open ended container is up-ended upon a hollow rod. Means are provided for holding the up-ended container over the hollow rod. Steam or compressed air are introduced to said hollow rod to thereby force the solid fats from the container or to force the container away from the fats. A collection area is provided underneath the up-ended container.

9 Claims, 3 Drawing Figures

SYSTEM FOR COLLECTION OF FATS AND OILS

TECHNICAL FIELD

The present invention relates to a system for collecting fats and oils, and a container to transport them to a processing plant or consolidation point. In particular, the present invention relates to such a system and container for collecting spent fats and oils and accumulated greases from restaurants, fast food outlets, shops, factories and the like.

Throughout the specification and claims the term "fats" will be used to describe spent fats and oils and greases from food or any combinations thereof.

In existing systems the proprietors of restaurants and the like pour the spent or used fats into 200 liter closed top drums which, when full, are removed by fat and oil collectors in table top trucks to a processing plant or to a consolidation point. The fats and oils when cooled to room temperature solidify into an extremely hard block, and would contain solid food wastes. This system suffers from several disadvantages:

(1) The 200 liter drums are inconvenient to store in the premise from which the fats are collected.

(2) The 200 liter drums are difficult to handle in and out of the premise from which it is collected, especially as the all up weight of the fats and drum would be approximately 200 kilos, and in most cases, a 200 kilo container is too big and heavy for most restaurants to handle and would need to be kept outside. The fats saved from the cooking process would then need to be carried in another container (probably the 20 liter drum the fats and oils were purchased in) and poured into the large open top drum to cool and thus solidify. This is inconvenient for a restaurant and subject to pollution from rain and other sources.

(3) The fat and oil is not sold to the restaurant, etc., in this type of container. The collector would need to supply this particular container to the restaurant and would then need to repair and wash the drum from time to time at considerable expense.

(4) A solid block of used fats weighing approximately 200 kilos is too big to inspect to determine if there is only fats going into the tank on the truck. If there are materials in the drum other than fats of the required quality, then they will also be tipped into the tank on the truck. At best, this means that the collector is getting material that is not wanted and which will have to be removed later, while at worst, the whole load could be contaminated and ruined. The collector would only find this out when processing the load at the treatment depot and would have no way of knowing where the offending material came from.

(5) At the processing plant or consolidation point, the 200 liter drums are difficult and expensive to melt out to remove all of their contents and create odour and pollution problems, and are generally difficult and dangerous to handle, as the drums are invariably hot and slippery and weigh in excess of 220 kilos.

Other systems have been proposed, such as those disclosed in U.S. Pat. Nos. 4,237,857 and 4,450,828, in which 200 liter (44 gallon) drums are lifted by a winch or crane and lowered into a heating bath to soften the solidified fats adjacent the walls of the drum, and then the drum is raised out of the heating bath and tipped so that the fats slide out of the drum into a collection area of the truck. Usually the thus heated fat will be in a solid block.

These system, as well as suffering from the previously mentioned disadvantages, also suffer from the following:

(1) Because the fats inside the drum are extremely hard, the system relies on the drum remaining perfactly round. Open top drums have very little strength around the top rim to resist distortion, and if the top is not perfectly round, the block of fats will jam and not come out. This would cause problems if suspended above the tank in a hot, greasy, dripping condition, particularly as the all up weight of the fat and drum would be approximately 200 kilos.

(2) Handling 200 kilo drums of fats which are wet and greasy above a vehicle and tipping through an opening in the top of the truck is a hazardous operation that would cause injury and damage if the holding apparatus let go of the drum-a quite realistic probability from time to time.

SUMMARY OF THE INVENTION

In one broad form the invention comprises an apparatus adapted to remove solidified fats from a container comprising:

a hollow rod upon which the up-ended open drum of fat is placed with the rod inserted into the solid block of fats contained therein to reach the bottom of the container;

a holding means to retain said drum over said rod; and means to pass compressed air or steam through said rod so as to force said solid block of fats out of said drum or said drum away from around said block of fats.

Preferably there is associated with said hollow rod a heated grid through which the block of fats passes to dissect the block of fats into smaller pieces.

Thus, the present invention seeks to ameliorate the disadvantages of the prior art systems by providing a system whereby the restauranteur, etc., stores the spent fats in the 20 liter open top containers, in which the original fat and oils are purchased by the restauranteur, etc., for use, and the spent fats are collected and stored therein.

The 20 liter containers are then collected and the solidified fats are removed by the apparatus of the present invention, and then transported by tanker to a processing plant or consolidation point.

Thus, the system of the present invention has the following advantages over the prior art systems:

(1) It is not necessary to supply, repair or wash the drums.

(2) The drums can be handled in the normal course of operations in a restaurant. It is not necessary for them to be stored outside the restaurant and the risk of pollution of the contents is minimised.

(3) A hot rod is inserted through the fats to the top of the up-ended drum and compressed air or steam is passed up the hot rod thereby creating a pocket of expanding hot air or steam which forces the fats out of the drum. This system gives the option of holding the drum in position and allowing the pressure to eject the block of fats into a container or allowing the pressure to eject the drum from around the block of fats.

(4) The system outlined in (3) not only removes the block of fats quickly from the drum but, because of the small volume and easy visibility, an inspection of the contents can be made to ensure no polluting substances are present. If polluting substances are present, the material can be drained back into the drum from the small tank into which the fats are first placed, without contaminating the whole load.

With the embodiment using the grid the following advantages are obtained:

(1) By allowing the compressed air or steam pressure to force the block of fats past an arrangement of heated bars or rods, the small block of fats are dissected into pieces small enough to pass through a 3 inch to 6 inch diameter pipe. If this pipe is connected to the large storage tank on the truck and a vacuum is drawn on the tank, the dissected pieces of fats will pass readily into the storage tank. If preferred, an auger or other transfer system can be used to put the softened and partly melted fat segments into the large storage tank.

(2) Fats melt very slowly in a large block. By dissecting the block of fats into small pieces, this invention enables the fats in the storage tank to be melted quicker thereby enabling a quick unloading, when the truck returns to its depot.

BRIEF DESCRIPTION OF THE FIGURES

The invention will now be described by way of example with reference to the accompanying drawings in which.

Figure 1:
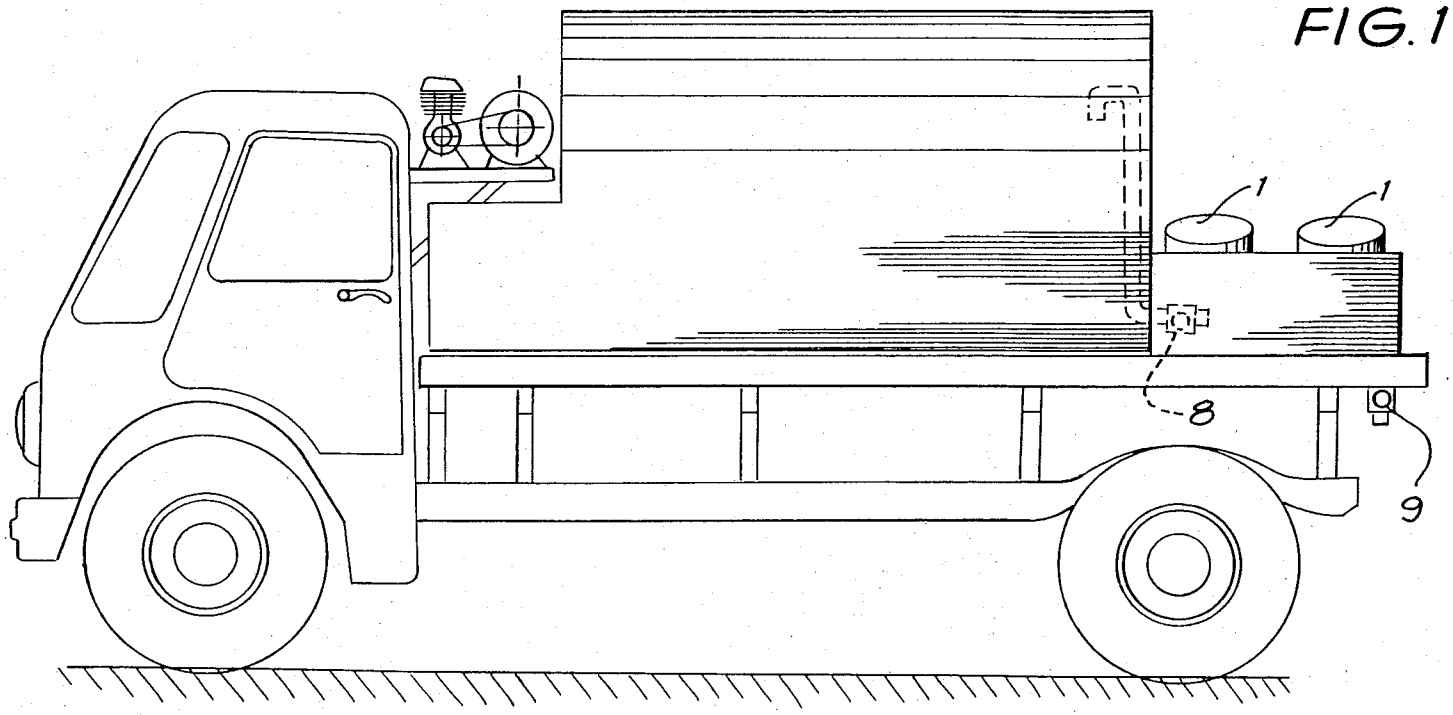
FIG. 1 illustrates one embodiment of the present invention incorporated with a tanker.

The invention can be used as a portable unit able to be lifted on and off vehicles as required or built into a dedicated tanker, as shown in FIG. 1.

Figure 3:
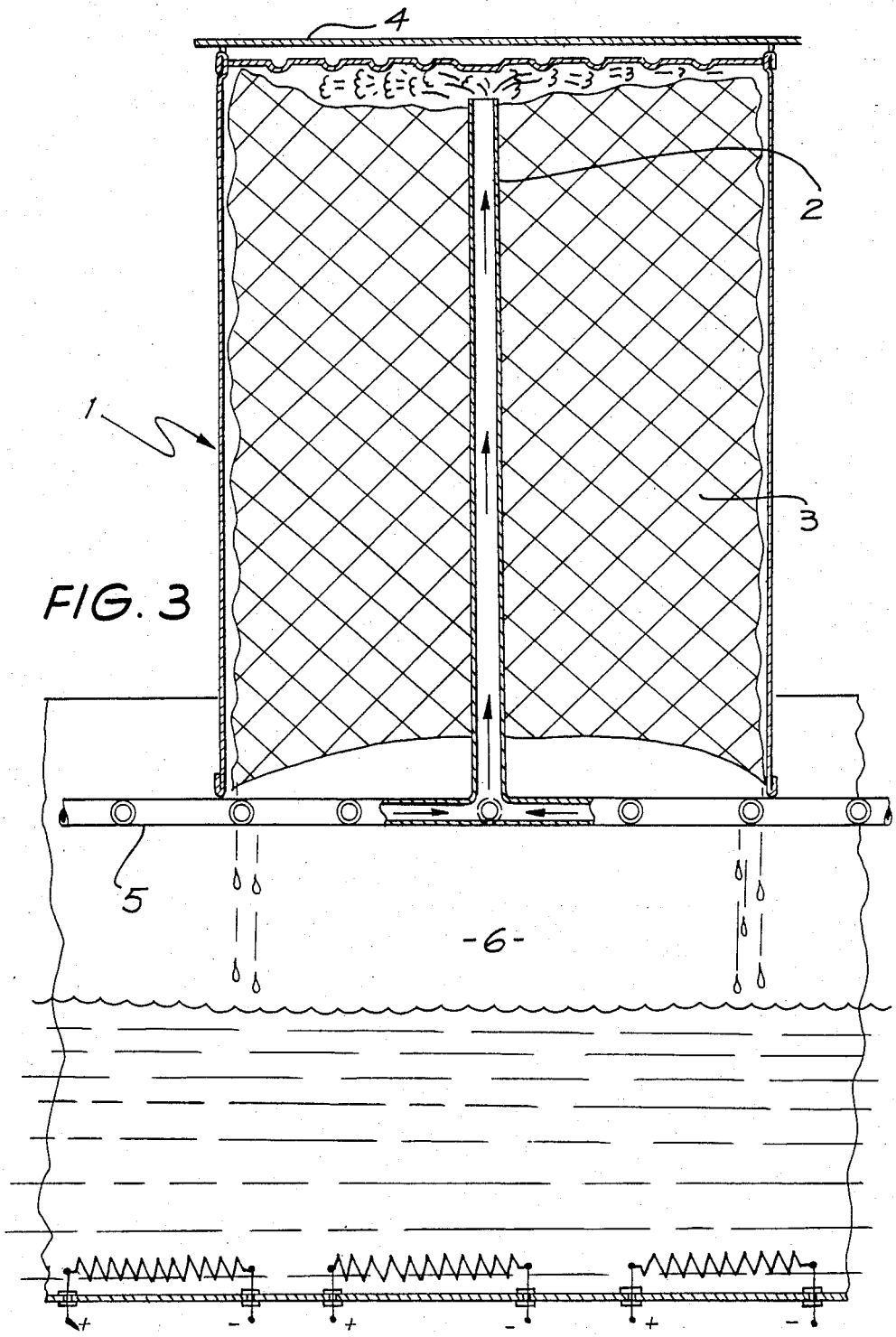
FIG. 3 illustrates one embodiment of the present invention.

One embodiment of the present invention is shown in FIG. 3. In use, a drum 1 (20 liters) of solidified fats, is impaled on a hollow rod 2 with the rod 2 passing from the open end of the container into the solidified block of fats 3 until it reaches the bottom of the container. Compressed air or preferably stem is forced through the hollow rod 2. The drum 1 is held in place by suitable holding means 4 and the pressure of the compressed air or steam forces the block of fats 3 out of the drum 1. The drum can rest on a heated grid 5, which is preferably heated by steam such that, as the block of solidified fats 3 is forced out of the drum, it is forced through the grid and cut into small pieces which will pass through a 75 to 100 mm diameter pipe.

Further, heating coils 7 could be used to keep the fats in the chamber 6 below the collection area in a liquid state.

Figure 2:
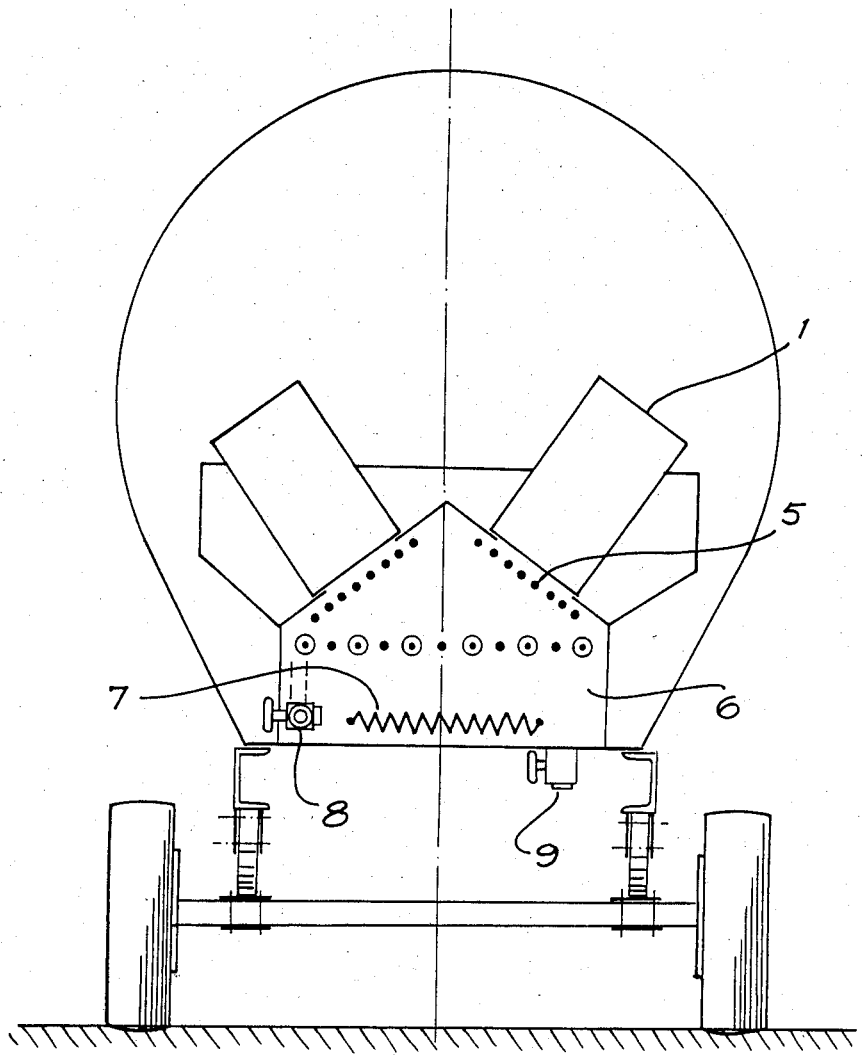
FIG. 2 illustrates schematically the arrangement of the embodiment illustrated in FIG. 1.

As shown in FIGS. 1 and 2, the collection area could be located at the back of the tanker at a relatively low height for ease of access by the tanker operator. A simple hinged cover could be used to cover the collection area when it is not in use.

The fat melting tank can be constructed so that the sliced blocks of fats is directed into the melting tank by a series of sloping surfaces that also act as the lid of the melting tank. These sloping surfaces are so arranged that the melted fats are prevented from spilling out of the melting tank when the vehicle is moving. This lid can be hinged to give access for cleaning, etc.

The suction pipes and valves 8 should be contained inside the melting tank and the storage tanks to prevent the fat from solidifying and causing a blockage.

The suction end of the pipe 8 in the melting tank should be almost horizontal and to one side of the centre of the bottom of the tank so that the sliced blocks of fats can travel up the pipe together with the melted fat. This is because the sliced blocks of fats will mainly float horizontally, and it is best that the pipe entrance line up as much as possible with the floating slices of fat. To maximise this happening, it is desirable that the diameter of the pipe be from 75 to 100 mm, or even larger.

The objective is to melt only sufficient of the blocks of fats in the melting tank to enable the transfer of the fats to the storage tanks, where further melting can take place. If a large percentage of the fats can be transferred as unmelted slices, then the emptying of the drums will be quicker. For this purpose it is best if the blocks of fats are sliced into slices the length of the drum and approximately 50 mm by 50 mm thick, when the drum is being emptied.

A drain tap 9, 75 to 100 mm in diameter, can be positioned at the bottom of the melting-out tank so that unwanted material can be removed or the restaurant owner can be shown the material removed from the drums.

If it is required to keep different qualities of fats separate, a number of storage tanks may be connected to the melting-out tank, each with its own suction pipe and cut-off valve.

I claim:

1. An apparatus, adapted to remove a solidified block of fats from a container having an open end, comprising:

a hollow rod upon which the open end of the container of fats is placed with the rod inserted into the block of fats contained therein to reach the bottom of the container;

a holding means to retain the container over said rod; and, means to pass compressed air or steam through said rod so as to force the block of fats out of the container, or the container away from around said block of fats.

2. An apparatus according to claim 1, wherein the container is held in position over said rod and and said apparatus further comprises a heated grid located adjacent the open end of the container, such that the block of fats is forced out of the container and through said grid, dissecting said block into smaller blocks.

3. An apparatus according to claim 2, wherein said apparatus is located above a collection chamber which has heating means to keep fats in said collection chamber in a substantially liquid form.

4. An apparatus according to claim 1, wherein said apparatus is located above a collection chamber which has heating means to keep fats in said collection chamber in a substantially liquid form.

5. Apparatus according to claim 4 including a holding tank and a suction means, which means sucks the melted and blocks of fats from said collection chamber into the holding tank.

6. An apparatus according to claim 5, wherein said collection chamber has a drain valve to remove unwanted material.

7. An apparatus according to claims 1, 2, 4, 5, 6, 7 or 3 mounted into a dedicated tanker.

8. An apparatus according to claims 1, 2, 4, 5, 6 or 3, wherein said apparatus is a portable unit able to be connected to, or carried on vehicles.

9. A method for the collection of fats and greases from restaurants comprising the steps of:

(a) providing 20 liter open top drums for storage of the fats and greases to be collected;

(b) providing a hollow rod upon which the open end of the drum of fats is placed with the rod inserted into the block of fats contained therein to reach the bottom of the drum; a holding means to retain the drum over said rod; and, means to pass compressed air or steam through said rod so as to force the block of fats out of the drum or the drum away from around said block of fats;

(c) storing the used fats in the 20 liter open top drums;

(d) up-ending the open top drum onto the hollow rod such that the hollow rod penetrates the solid block of fats to reach the bottom of the drum:

(e) holding the drum in position with said hollow rod impaled through the block of fats in the open top drum; and, (f) passing compressed air or steam through said hollow rod to force the block of fats out of said drum.

* * * * *